US008177601B2

(12) United States Patent
Ekstein-Lieberman

(10) Patent No.: US 8,177,601 B2
(45) Date of Patent: May 15, 2012

(54) PEEK-A-BOO DOLL WITH DUAL ACTIVATION

(76) Inventor: Penny Ekstein-Lieberman, New York, NY (US)

( * ) Notice: Subject to any disclaimer, the term of this patent is extended or adjusted under 35 U.S.C. 154(b) by 1158 days.

(21) Appl. No.: 11/893,777

(22) Filed: Aug. 16, 2007

(65) Prior Publication Data

US 2008/0102729 A1 May 1, 2008

Related U.S. Application Data

(60) Provisional application No. 60/855,798, filed on Nov. 1, 2006.

(51) Int. Cl.
*A63H 30/00* (2006.01)

(52) U.S. Cl. ..... 446/175; 446/268; 446/297

(58) Field of Classification Search ..... 446/175, 446/297, 303, 385–389, 392
See application file for complete search history.

(56) References Cited

U.S. PATENT DOCUMENTS

| | | | | |
|---|---|---|---|---|
| 3,239,961 | A * | 3/1966 | Forkner | 446/130 |
| 4,294,033 | A | 10/1981 | Terzian | |
| 4,516,950 | A | 5/1985 | Berman et al. | |
| 4,521,205 | A | 6/1985 | Spector | |
| 4,585,424 | A * | 4/1986 | DeMars | 446/295 |
| 4,659,920 | A | 4/1987 | Nishiura et al. | |
| 4,853,994 | A | 8/1989 | Ekstein | |
| 4,917,647 | A | 4/1990 | Wetherell et al. | |
| 4,923,428 | A | 5/1990 | Curran | |
| 5,092,811 | A | 3/1992 | Bergenguer | |
| 5,158,492 | A | 10/1992 | Rudell et al. | |
| 5,209,691 | A | 5/1993 | Ekstein | |
| D336,943 | S | 6/1993 | Ekstein | |
| 5,376,038 | A | 12/1994 | Arad et al. | |
| 5,413,516 | A | 5/1995 | Lam | |
| 5,501,627 | A * | 3/1996 | Ekstein | 446/175 |
| 5,700,178 | A * | 12/1997 | Cimerman et al. | 446/301 |
| D393,498 | S | 4/1998 | Lieberman | |
| 6,264,523 | B1 | 7/2001 | Simmons | |
| 6,585,556 | B2 | 7/2003 | Smirnov | |
| 6,631,351 | B1 | 10/2003 | Ramachandran et al. | |
| 2001/0053651 | A1 | 12/2001 | Wright | |
| 2004/0077265 | A1 * | 4/2004 | Ghaly | 446/175 |
| 2005/0148279 | A1 | 7/2005 | Maa | |
| 2006/0009113 | A1 | 1/2006 | Fong et al. | |
| 2006/0084362 | A1 | 4/2006 | Ghaly | |
| 2006/0094332 | A1 | 5/2006 | Ghaly | |

* cited by examiner

*Primary Examiner* — Dmitry Suhol
*Assistant Examiner* — Alex F. R. P. Rada, II
(74) *Attorney, Agent, or Firm* — William E. Pelton, Esq.; Cooper & Dunham LLP

(57) ABSTRACT

The invention provides a toy that talks when activated. The toy may be activated by simulating play with the toy or by changing the illumination of the toy's environment. Through electronic circuitry, the toy produces a sound output when its magnetic sensor detects a magnet nearby or when its photo-sensor detects a change in the level of illumination in the surrounding area. The toy may be used for peek-a-boo play involving children.

12 Claims, 4 Drawing Sheets

PEEK-A-BOO DOLL WITH DUAL ACTIVATION

REFERENCE TO RELATED APPLICATIONS

This application claims the benefit of U.S. Provisional Patent Application No. 60/855,798 filed Nov. 1, 2006 which is incorporated herein by this reference.

BACKGROUND OF THE INVENTION

The present invention relates to the general field of children's toys of the type having sensor activated behavior.

The typical type of toy with which the invention is specifically concerned is a doll that reacts to certain stimuli with an activated behavior, such as crying or making some other sound, waving a hand, or dancing. Although the description that follows is directed to a talking doll, the invention is not limited to this particular form of implementation.

To elicit the behavior from such dolls, an activation step is required. For instance, dolls having a pull string which, when pulled, causes a doll to speak simple preprogrammed words are well known. Additionally, toggle switches, buttons, loud noises and points on a doll responsive to pressure are also known to activate speech and motion in toys.

Light can also trigger detectors to activate a toy or other device. For example, photosensors can detect darkness and, in response, turn on a light. Typically such devices monitor the amount of ambient light received by the photosensor, and when the amount of light received drops below a pre-established threshold, the light is turned on.

Such photosensors have been incorporated into dolls to elicit a response when the level of ambient light changes. For example, U.S. Pat. No. 5,501,627 describes a doll that has a photosensor located in each of the doll's eyes so that if either sensor is first exposed to ambient light, then deactivated by blocking the ambient light, such as by placing the doll's or the user's hand over at least one of the doll's eyes, a specific behavior, such as speech, is activated.

While conventional sensors can be used to elicit behavior from a toy such as a doll, such toys do not respond in an identical matter in both light and dark conditions while also allowing the toy to respond to changes in ambient light unrelated to use of the doll. Since ease of use is a primary goal, a toy such as a doll whose behavior can be activated in both light and dark conditions is desirable.

SUMMARY OF THE INVENTION

An object of the present invention is to provide a toy, such as a doll, that can speak, light up, or move in response to interaction with the user or as a result of changes in ambient light.

Another object of the present invention is to provide a toy, such as a doll, specifically designed to generate a voice output when playing a "peek a boo" game with a user in both light and dark conditions.

A further object is to provide a toy, such as a doll that is responsive to changes in ambient light.

To these and other ends, the present invention broadly contemplates a toy, such as a child's doll, having a head with eyes, wherein each of the toy's eyes contains both a photosensor and a magnetic sensor, the head being connected to a body with two or more appendages, such as arms, the appendages containing magnets to activate magnetic sensors in the eyes when they are brought into close proximity of each other, wherein the body and/or head contain an integrated circuit and/or a processor and software for producing a preprogrammed behavior upon activation of either of the photosensors or magnetic sensors located in the toy's eyes.

Specifically, the invention may be embodied in a doll designed to play "peek a boo" wherein the doll's head or body contains a speaker that will play a synthesized voice upon activation by either of the photosensors or magnetic sensors. Specifically, upon activation, the toy responds with the phrase "peek-a-boo, I see you, peek-a-boo, I love you." Also, lights may be placed in the doll's eyes or cheeks so that upon activation of the photo or magnetic sensors, the eyes or cheeks can be lit up.

Additionally, the dolls arms can be mechanically animated so that upon activation of the photo or magnetic sensors in the doll's eyes, the doll's arms can move without user interaction. In one embodiment, upon activation, the doll can move its arms to cover its eyes, such as a child would when playing "peek a boo".

The sensors in the toy's eyes can be activated in numerous different ways. The photosensors located in the toy's eyes are activated when covered and uncovered by the toy's hands or when the light in a room in which the toy resides is switched on. Similarly, the magnetic sensors are activated when a magnet in one of the toy's appendages is brought next to one of the magnetic sensor's in the toy's eyes. Because the toy can be activated by moving the appendages so as to make it play the familiar game of "peek a boo", the toy can be used by a child without having to learn any complicated steps or procedures to activate the doll's response. Additionally, because it contains both photo and magnetic sensors, the toy can be used in well lit areas as well as in total darkness. The invention provides a simple but safe and fun toy for children.

DETAILED DESCRIPTION OF THE PREFERRED EMBODIMENT

Figure 1:
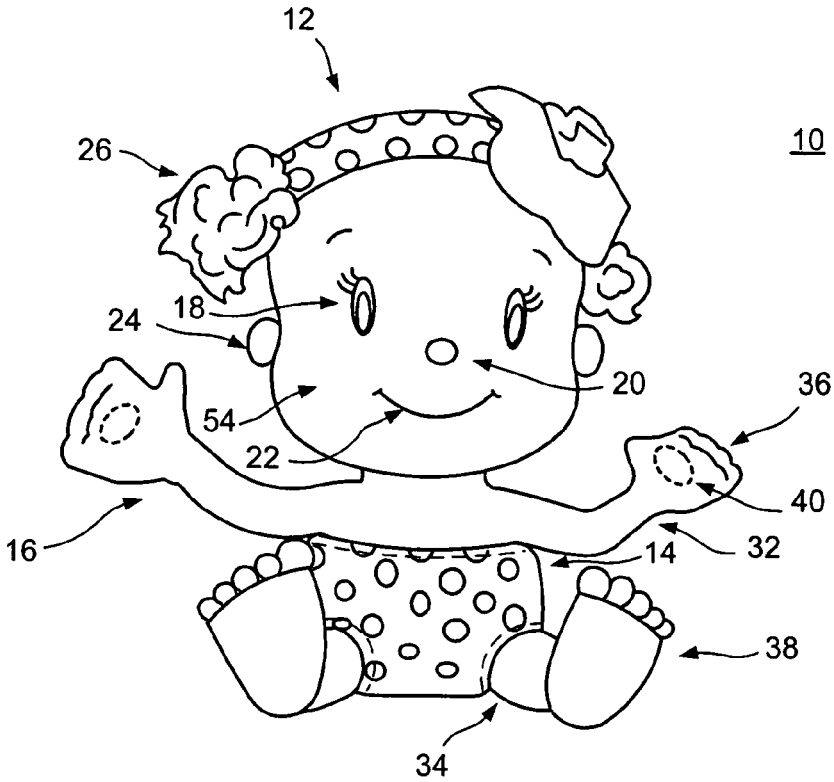
FIG. 1 is a front view of a toy embodying one embodiment of the present invention.
Figure 2:
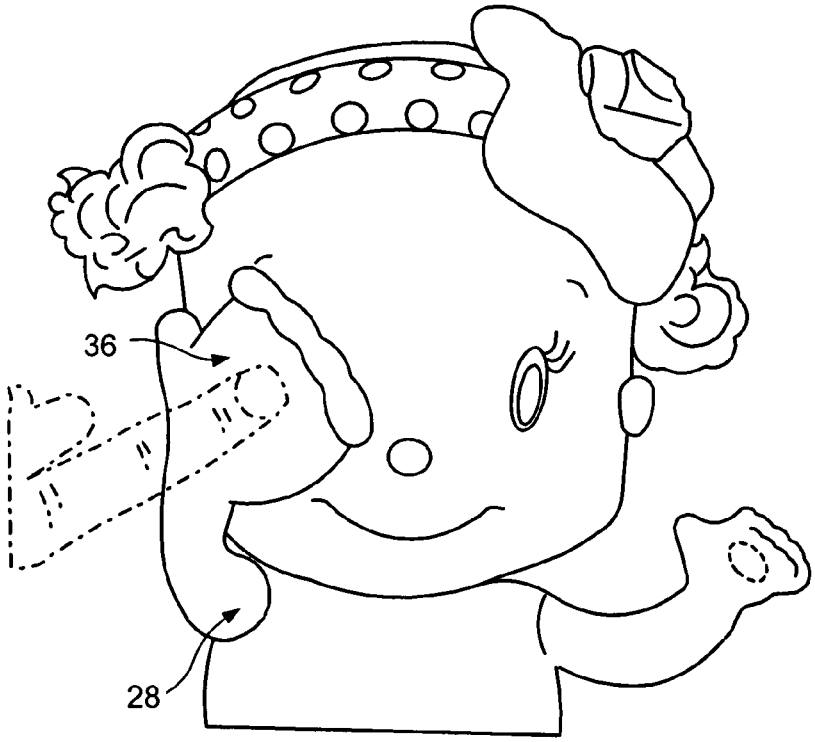
FIG. 2 is a front view showing the activation of one embodiment of the present invention.

In one embodiment, the peek-a-boo toy of the present invention incorporates a simple children's game into a figure portraying a baby or an animal. Referring to FIGS. 1, 2, 6 and 7, the toy FIG. 10 generally has a head 12, a torso 14, appendages 16, and identifying features such as eyes 18, nose 20, mouth 22, ears 24, and/or hair 26. The appendages 16 generally have a proximal end 28 and a distal end 30, including a magnet 40, relative to the point of attachment to the torso 14. On a baby toy figure, as in FIG. 1, the appendages are arms 32 and legs 34, with hands 36 and feet 38, respectively. On an animal toy figure (not shown) the appendages can be forelimbs and hindlimbs, and both can have paws. The appendages 16 are sufficiently flexible and have a length to allow movement to bring the distal end of the appendage proximate to one or more sensors. For example, the arms 32 of a baby toy figure are capable of being moved to bring the hands 36 over sensors in the eyes 18.

Figure 3:
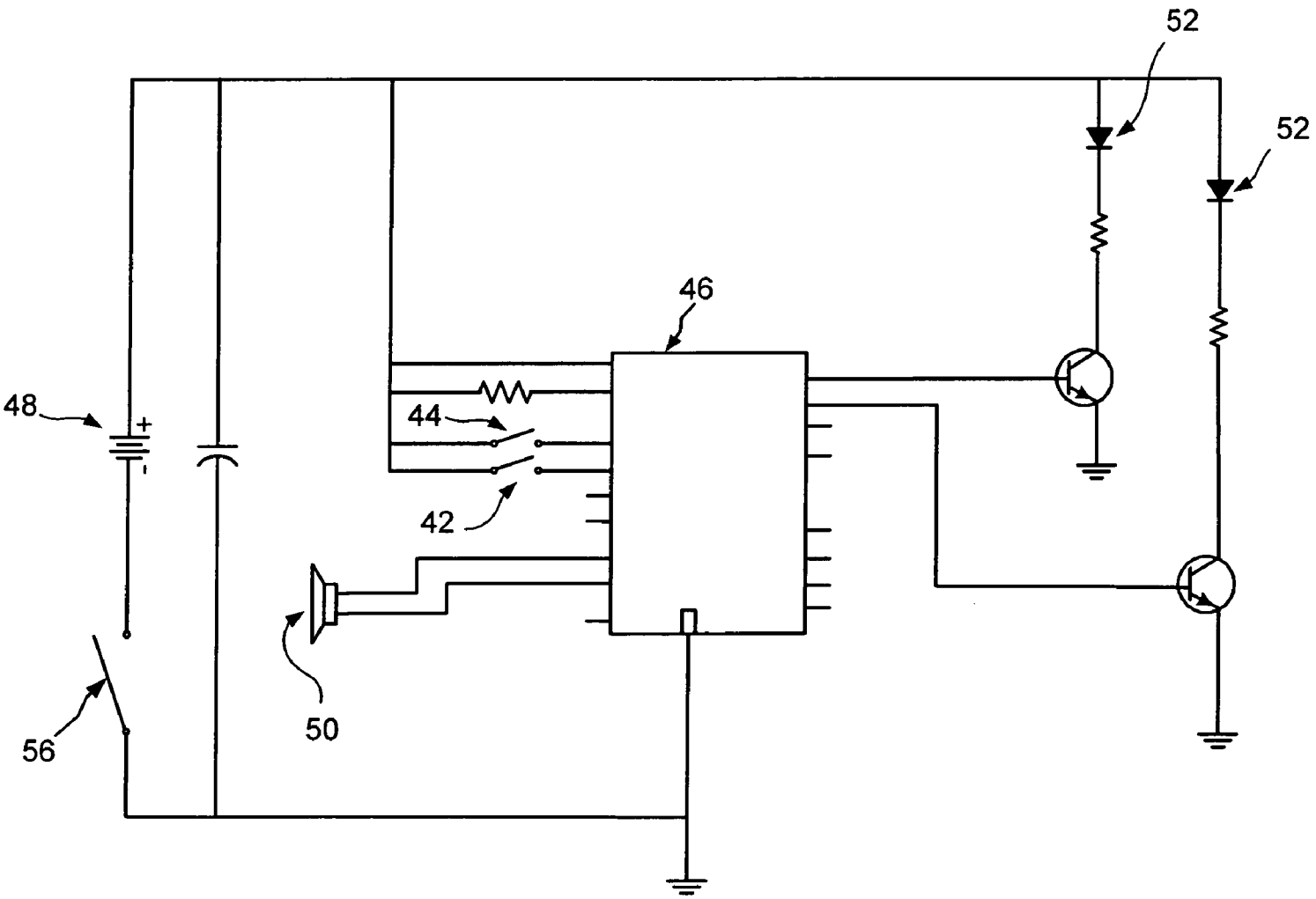
FIG. 3 is a circuit diagram showing the circuitry of one embodiment of the present invention.
Figure 4:
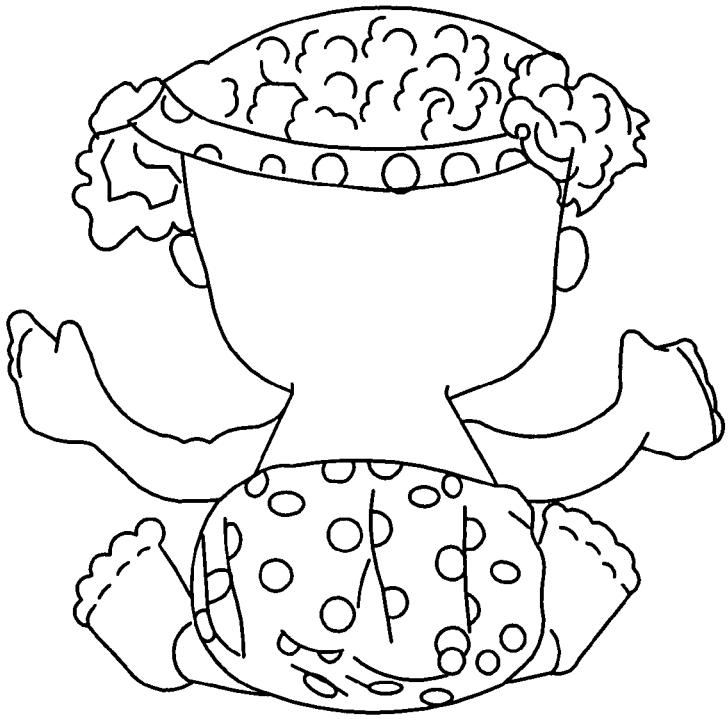
FIG. 4 is a back view of a toy of one embodiment of the present invention.
Figure 5:
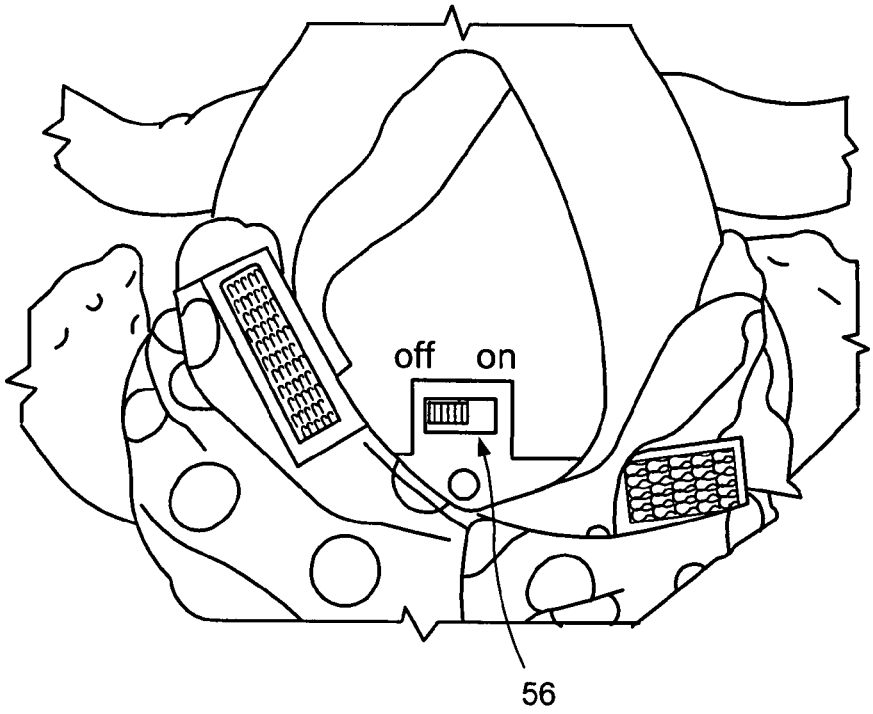
FIG. 5 is a back view showing the on/off switch and battery box of the toy in one embodiment of the present invention.
Figure 6:
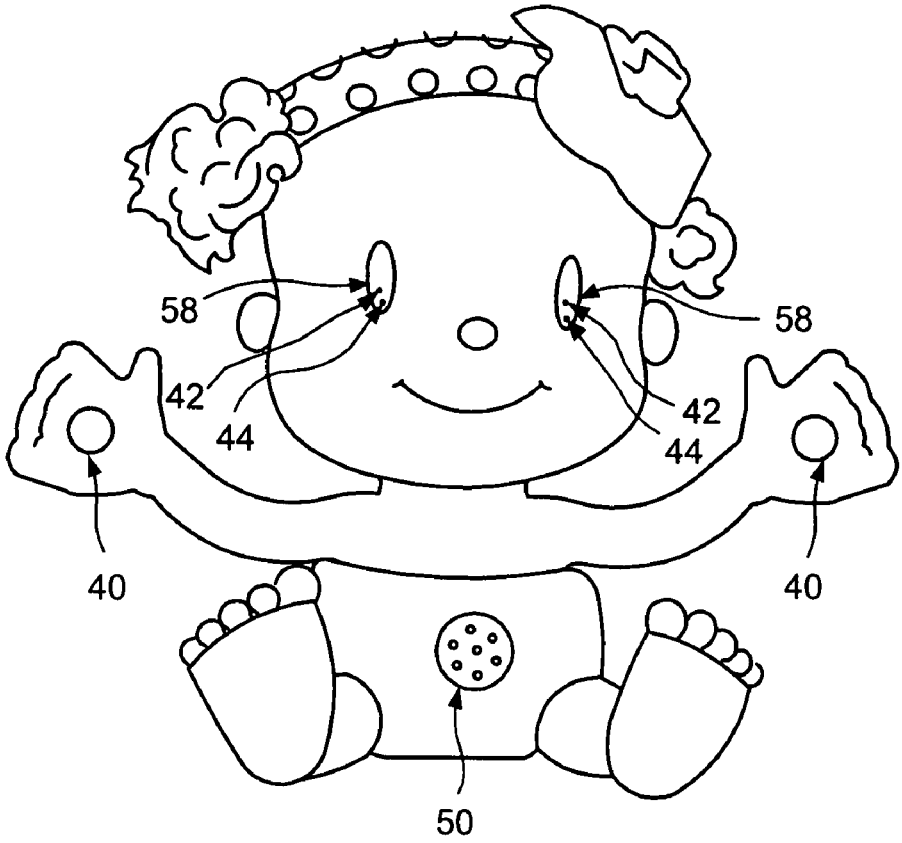
FIG. 6 is a front view of a toy of one embodiment of the present invention showing the location of particular components beneath the toy's surface.
Figure 7:
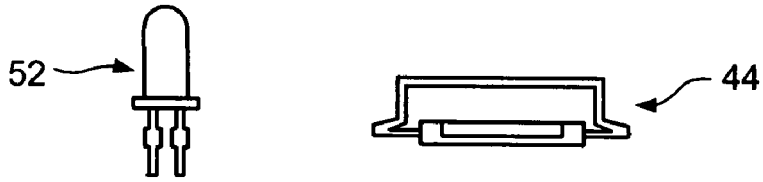
FIG. 7 is a front view of certain components that may be located within the toy of one embodiment of the present invention.

As can be seen in FIG. 6, in one embodiment, at least one of the toy's eyes contains both a photosensor 42 and a magnetic sensor 44 which in turn are connected to an integrated circuit 46 located within the torso 14 or head 12 of the toy. The integrated circuit 46, shown in the circuit of FIG. 3 which in one embodiment is mounted on a printed circuit board, is attached to a power source 48, such as two AA batteries, and contains a voice synthesizer that can play a prerecorded message through an attached speaker 50 when the circuit is activated. In one embodiment, the integrated circuit 46 is an EM5500 4-bit microcontroller unit manufactured by Elan Microelectronics Corp. of Taiwan. The attached speaker 50 may be connected to the voice synthesizer directly or through an amplifier. In one embodiment, when the integrated circuit 46 is activated, the speaker 50 plays a message, such as "peek-a-boo, I see you!" and/or "peek-a-boo, I love you!" The speaker 50 can be placed in either the toy's head 12 or its torso 14 and in one embodiment is a 160 ohm, 0.25 watt polyester speaker. In another embodiment of the present invention, upon activation the integrated circuit 46 can turn on lights 52 located in the toy's eye cavities 58 or cheeks 54. The lights are preferably light emitting diodes (LED) because they are durable, energy efficient and do not generate a large amount of heat.

In one embodiment, the integrated circuit 46 can be activated by triggering either or both of the magnetic sensors 44, which in one embodiment are reed switches, and/or either or both of the photosensors 42. It is understood that a processor and software can be used in place of or in addition to the integrated circuit 46 to perform the same tasks.

The integrated circuit 46 can be activated in several ways to elicit a response from the toy. One way utilizes the magnetic sensor 44 to trigger the integrated circuit 46 to respond when the magnetic sensor 44 is activated for a first time period, such as two seconds, and is then deactivated for a second time period, such as one-half second. By setting such a sufficiently long first time period, the toy will not accidentally be triggered if the magnet 40 briefly swings by the magnetic sensor 44 located in the eye 18. Likewise, by setting such a sufficiently long second time period, the toy will not be accidentally triggered if the magnet 40 momentarily slips away from the magnetic sensor 44. In a similar manner, the photosensor 42 can trigger a response from the integrated circuit 46 if either photosensor 42 is subjected to an amount of energy below a threshold for the first time period, such as two seconds, and is subsequently exposed to an amount of energy above a threshold amount for at least a second time period, such as one-half second. As discussed above regarding the magnetic sensor, setting the first time period longer than a certain duration will insure that the toy is not inadvertently triggered if the photosensor is momentarily obstructed. Likewise, by setting the second time period to a sufficiently long duration, the toy will not be activated when the photosensor is briefly exposed to light, such as when a user briefly lets the hand 36 slip thereby allowing a small amount of ambient energy to reach the photosensor 42.

In one embodiment, a sleep timer, which can be implemented in the integrated circuit 46, can be employed to prevent the doll from being inadvertently activated at night or by the rising sun. Specifically, the doll 10 can be set to enter a sleep state if the level of ambient light is not above a threshold for a predetermined amount of time, such as fifteen minutes. Once the doll 10 enters this sleep state, the integrated circuit 46 can not be activated through the photosensors 42 but instead must be activated by use of the magnet 40 and magnetic sensor 44. This function can be useful if, for instance, a person wanted to turn on the light in the room where the doll is located without inadvertently activating the doll's sound output, which might awaken a sleeping child. Moreover, the child could still activate the doll in the dark by using the magnetic sensor 44, which would also reset the sleep timer. Alternatively or additionally, a manual on/off switch 56, preferably located on the doll's back, can be used to completely shut off the doll, so that even the magnetic sensor 44 will not activate the doll. Moreover, in one embodiment the sleep timer an also be reset by toggling the on/off switch 56 to the "off" position and then back to the "on" position.

When engaged in play, a child may move one or more of the toy's appendages 16 to cover at least one of the eyes 18 such as the hand 36 (see FIG. 2) and then uncover the eyes by moving the appendages 16 away from the eyes 18. This action activates the integrated circuit because the magnetic sensor 44 located in the eyes 18 detects the magnet 40 located in the hands 36 as the eyes 18 are covered. As discussed above, the integrated circuit 46 will then produce a sound output, such as a prerecorded message, through the speaker 50. Similarly, the sound output may be generated when the photosensor 42 located in the eyes 18, detects a change in illumination due to either or both of the eyes 18 being covered and uncovered with either the toy's hands 36, the user's own hands (not shown) or a light being turned on in a room (not shown) where the toy resides. The use of both photosensors 42 and magnetic sensors 44 is advantageous because the toy can be activated merely by turning the lights on in the room where the toy resides and allows a child to activate the toy by covering the toy's eyes 18 with the child's own hands (via the photosensors 42) yet it still works in the dark because of the magnetic sensors 44 and the magnets 40 located in the toys hands 36.

In another embodiment of the invention, the activation of the sound output may coincide with activation of one or more lights located in the eyes 18 or cheeks 54. The light may light up as the toy says "peek-a-boo, I see you, peek-a-boo, I love you", or some other prerecorded message, and switch off as the sound output ends.

The toy 10 may be made of plastic, fabric, or any other material that accommodates flexibility in the appendages 16.

This invention is not limited to the features and embodiments hereinabove specifically set forth, but may be carried out in other ways without departure from its spirit.

I claim:

1. A toy comprising:

an eye joined to a body, the eye having a first sensor and a second sensor, the first sensor responsive to an activator and the second sensor responsive to ambient energy;

an appendage joined to the body at a proximal portion of the appendage, the appendage having an activator joined to a distal portion of the appendage and capable of movement such that the activator can be moved with the appendage into and out of a detection range of the first sensor; and a speech generator including circuitry: (a) which generates speech when the first sensor detects the activator for a first time period and does not detect the activator for a second time period; and (b) which generates speech when the second sensor detects ambient energy below a threshold for a third time period and then detects ambient energy above the threshold for a fourth time period.

2. The toy of claim 1 wherein the activator is a magnet.

3. The toy of claim 1 wherein the ambient energy is light.

4. The toy of claim 1 wherein the second time period and the fourth time period are the same.

5. A toy comprising:

a body having a first sensor and a second sensor positioned on the body within approximately one centimeter of each other, the first sensor operable in the dark and the second sensor operable with light;

an appendage joined to the body at a proximal portion of the appendage, the appendage having an activator joined to a distal portion of the appendage and capable of movement such that the activator can be moved with the appendage into and out of a detection range of the first sensor; and an action generator including circuitry: (a) which causes the toy to perform an action when the first sensor detects the activator for a first time period and does not detect the activator for a second time period; and (b) which causes the toy to perform an action when the second sensor does not detect ambient energy above a threshold for a third time period, and then detects ambient energy above the threshold for a fourth time period.

6. The toy of claim 5 wherein the action is speech from a speech generator.

7. The toy of claim 5 wherein the action is emitting light from one or more light sources on the body.

8. The toy of claim 7 further comprising:

at least one cheek, wherein the at least one or more light sources is positioned in the at least one cheek.

9. The toy of claim 7 wherein the body has at least one eye.

10. The toy of claim 9 wherein at least one of the light sources is positioned in the eye.

11. The toy of claim 9 wherein the at least one or more light sources is positioned in the at least one eye.

12. A method of operating a toy having: (1) an eye joined to a body, the eye having a first sensor and a second sensor, the first sensor responsive to an activator and the second sensor responsive to ambient energy; (2) an appendage joined to the body at a proximal portion of the appendage, the appendage having an activator joined to a distal portion of the appendage and capable of movement such that the activator can be moved with the appendage into and out of a detection range of the first sensor; and (3) a speech generator including circuitry: (a) which generates speech when the first sensor detects the activator for a first time period and does not detect the activator for a second time period; and (b) which generates speech when the second sensor detects ambient energy below a threshold for a third time period and then detects ambient energy above the threshold for a fourth time period; comprising the steps of:

moving the distal portion of the appendage into the detection range; and moving the distal portion of the appendage out of the detection range.

* * * * *